US010644426B2

(12) United States Patent
Kimura et al.

(10) Patent No.: US 10,644,426 B2
(45) Date of Patent: May 5, 2020

(54) CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Akio Kimura, Mie (JP); Kyohei Ida, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/314,695

(22) PCT Filed: Jun. 20, 2017

(86) PCT No.: PCT/JP2017/022642
§ 371 (c)(1),
(2) Date: Jan. 2, 2019

(87) PCT Pub. No.: WO2018/008382
PCT Pub. Date: Jan. 11, 2018

(65) Prior Publication Data

US 2019/0319387 A1 Oct. 17, 2019

(30) Foreign Application Priority Data

Jul. 6, 2016 (JP) ..... 2016-134119

(51) Int. Cl.
*H01R 13/187* (2006.01)
*H01R 13/436* (2006.01)

(52) U.S. Cl.
CPC ..... *H01R 13/187* (2013.01); *H01R 13/4367* (2013.01)

(58) Field of Classification Search
CPC .. H01R 4/4872; H01R 4/4863; H01R 13/187; H01R 13/33; H01R 13/4367
(Continued)

(56) References Cited

U.S. PATENT DOCUMENTS 2,882,514 A * 4/1959 Krantz ..... H01R 13/33 439/752
3,614,296 A * 10/1971 Blomstrand ..... H01R 4/22 174/87
(Continued)

FOREIGN PATENT DOCUMENTS

JP 2008-204634 9/2008
JP 2012-134150 7/2012
(Continued)

OTHER PUBLICATIONS

International Search Report dated Sep. 5, 2017.

*Primary Examiner* — Gary F Paumen
(74) *Attorney, Agent, or Firm* — Gerald E. Hespos; Michael J. Porco; Matthew T. Hespos

(57) ABSTRACT

A connector (C) includes a flat terminal (20), an obliquely wound coil spring (10) wound around a winding axis (A) that is parallel to the terminal (20) with the coil spring (10) sandwiched between the terminal (20) and a flat mating terminal (71). A connector housing (30) accommodates the terminal (20) and the coil spring (10) and includes an insertion path (37) for the mating terminal (71) to be parallel to the terminal (20). A rotation restricting portion (33) is in the connector housing (30) and restricts the coil spring (10) in a rotation posture to tilt with respect to the winding axis (A) such that a mating terminal side of a half-turn winding plane and a straight line connecting a start point (P1) and an
(Continued)

end point (P2) of the half turn is on a back side in an inserting direction of the mating terminal (71).

12 Claims, 8 Drawing Sheets

(58) Field of Classification Search
USPC ..... 439/817, 840, 841, 843–845
See application file for complete search history.

(56) References Cited

U.S. PATENT DOCUMENTS

| | | | | |
|---|---|---|---|---|
| 4,462,657 | A * | 7/1984 | Snowdon | H01R 13/187 439/724 |
| 4,632,496 | A * | 12/1986 | Williams | H01R 13/187 439/654 |
| 8,735,751 | B2 * | 5/2014 | Rust | H01R 13/187 200/276 |
| 8,753,153 | B2 * | 6/2014 | Leon | B21F 1/00 439/840 |
| 2007/0037456 | A1 * | 2/2007 | Burgess | H01R 13/187 439/841 |
| 2007/0042648 | A1 * | 2/2007 | Balsells | F16F 1/045 439/817 |
| 2010/0279558 | A1 * | 11/2010 | Leon | H01R 13/17 439/817 |
| 2011/0124245 | A1 * | 5/2011 | Fujita | H01R 13/17 439/840 |
| 2012/0003882 | A1 * | 1/2012 | Stewart | H01R 13/111 439/840 |
| 2012/0003883 | A1 * | 1/2012 | Pavlovic | H01R 13/187 439/840 |
| 2012/0129409 | A1 * | 5/2012 | Drew | A61N 1/3752 439/843 |
| 2012/0174398 | A1 * | 7/2012 | Rust | H01R 13/33 29/876 |
| 2013/0130556 | A1 * | 5/2013 | Blakborn | H01R 13/187 439/626 |

FOREIGN PATENT DOCUMENTS

| | | |
|---|---|---|
| JP | 2012-248495 | 12/2012 |
| JP | 2013-535777 | 9/2013 |
| JP | 2015-60646 | 3/2015 |
| JP | 2016-46156 | 4/2016 |

* cited by examiner

CONNECTOR

BACKGROUND

Field of the Invention

This specification relates to a connector.

Related Art

A connector generally is configured to fit and connect a pair of terminals. A connector configured such that two terminals are connected with a conductive spring laid and sandwiched between the terminal also is known. An obliquely wound conductive coil spring 10, as shown in FIGS. 8 and 9, is used in such a known connector. This obliquely wound coil spring 10 is formed by winding a conductive wire 11 in a state inclined in one direction with respect to a winding axis A.

If a straight line L connecting an arbitrary start point P1 of the wire 11 and an end point P2 reached by winding a half turn and a virtual plane defined by the wire 11 between the points P1 and P2 (hereinafter, this is called a "half-turn winding plane") are seen, an angle of inclination a of any half-turn winding plane with respect to the winding axis A differs every half turn, but within 90 degrees in the obliquely wound coil spring 10. In contrast, in a general compression coil spring, inclinations of the half-turn winding planes with respect to a winding axis A are alternately (90−β) and (90+β), as shown in FIG. 10.

If loads are applied to sandwich such an obliquely wound coil spring 10 from both sides of an outer peripheral surface (directions of arrows in FIG. 9), as shown in FIG. 9, the obliquely wound coil spring 10 is compressed to tilt each half-turn winding plane further (to make a smaller) with respect to the winding axis A.

A contact structure using an obliquely wound coil spring is known from Japanese Unexamined Patent Publication No. 2008-204634. Specifically, a groove is provided on the outer periphery of a cylindrical terminal and a conductive obliquely wound coil spring having both end parts joined to have an annular shape is arranged in the groove. A hollow cylindrical terminal is fit externally to the cylindrical terminal. Thus, the obliquely wound coil spring is sandwiched between the terminals and a load is applied to the outer peripheral surface of the obliquely wound coil spring to compress the obliquely wound coil spring. In this way, the terminals are connected.

However, the hollow cylindrical terminal of Japanese Unexamined Patent Publication No. 2008-204634 is required to have high dimensional accuracy to fit the terminals to each other and has to be manufactured by cutting. Further, a groove structure for holding the spring on the outer peripheral surface of the cylindrical terminal generally is formed by cutting. Thus, the problem has been that the manufacturing cost of these terminals is high.

SUMMARY

A connector disclosed in this specification includes a terminal in the form of a flat plate. An obliquely wound coil spring formed by spirally winding a conductive wire with respect to a winding axis is disposed such that the winding axis thereof and the terminal are parallel. The coil spring can be sandwiched between the terminal and a mating terminal in the form of a flat plate. A connector housing is configured to accommodate the terminal and the obliquely wound coil spring and includes an insertion path. The mating terminal is inserted into the insertion path to be parallel to the terminal. A rotation restricting portion is provided in the connector housing and is configured to restrict the obliquely wound coil spring in such a rotation posture as to tilt with respect to the winding axis such that a mating terminal side of a half-turn winding plane defined by a half turn of the wire and a straight line connecting a start point and an end point of the half turn is on a back side in an inserting direction of the mating terminal and a terminal side thereof is on a front side in the inserting direction.

In this configuration, when the mating terminal is inserted into the insertion path and becomes parallel to the terminal, the obliquely wound coil spring is sandwiched between the mating terminal and the terminal. Therefore, the terminal and the mating terminal are connected electrically. At this time, if the half-turn winding plane is inclined with respect to the winding axis of the obliquely wound coil spring such that the mating terminal side is on the front side in the inserting direction of the mating terminal and the terminal side is on the back side in the inserting direction of the mating terminal, the mating terminal is caught by a part of the obliquely wound coil spring to be brought into contact with the mating terminal and it is difficult to insert the mating terminal. However, in the above configuration, the obliquely wound coil spring is restricted in the rotation posture to tilt with respect to the winding axis thereof by the rotation restriction portion such that the mating terminal side is on the back side in the inserting direction of the mating terminal, and the terminal side is on the front side in the inserting direction of the mating terminal. Thus, the mating terminal is not likely to be caught by the obliquely wound coil spring, and an insertion force for the mating terminal can be reduced. Further, the terminal is a flat plate formed by simple press-working. Therefore, cost can be reduced.

The connector housing may include a spring accommodating portion configured to accommodate the obliquely wound coil spring, and the rotation restricting portion may be configured by making a facing dimension between the terminal and a part of an inner wall of the spring accommodating portion facing the terminal smaller than an outer diameter of the obliquely wound coil spring in a direction perpendicular to a facing direction.

In this configuration, the obliquely wound coil spring is accommodated into the spring accommodating portion provided between the insertion path and the terminal accommodating portion to communicate with the both. When the obliquely wound coil spring is accommodated at a predetermined position, the rotation of the obliquely wound coil spring can be suppressed and a change in the inclination of the obliquely wound coil spring can be restricted even if the obliquely wound coil spring is going to rotate since the dimension between the terminal and the part of the inner wall of the spring accommodating portion facing the terminal is smaller than the outer dimension of the obliquely wound coil spring in the direction perpendicular to the facing direction.

The spring accommodating portion may include a shaft portion provided along the winding axis of the obliquely wound coil spring and inserted in the obliquely wound coil spring.

In this configuration, the shaft portion can fulfill a guiding function in accommodating the obliquely wound coil spring into the spring accommodating portion. Further, excessive deflection of the obliquely wound coil spring can be suppressed.

According to the connector disclosed in this specification, cost can be reduced while the obliquely wound coil spring is used for connection.

DETAILED DESCRIPTION

An embodiment is described with reference to FIGS. 1 to 9.

Figure 3:
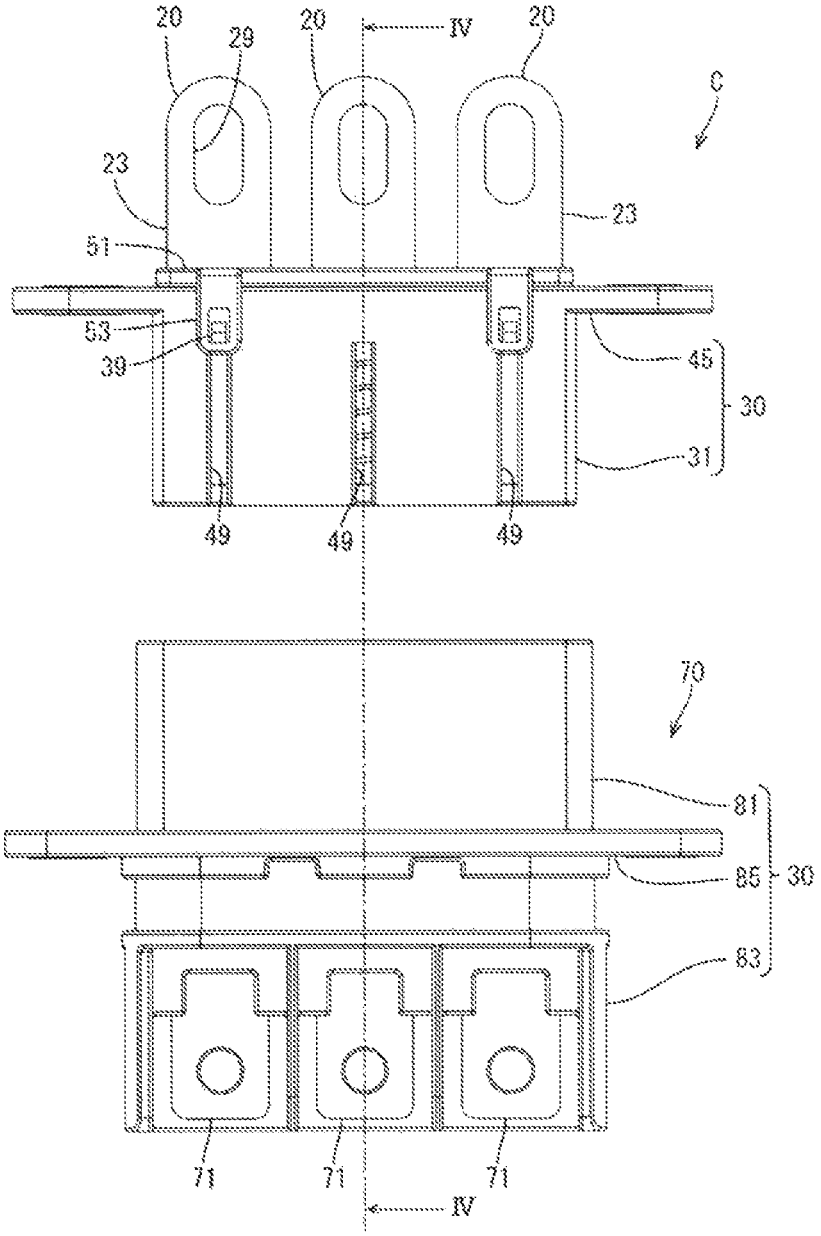
FIG. 3 is a plan view in a state before connection to a mating connector.

A connector C of this embodiment is fit and connected to a mating connector 70 as shown in FIG. 3. Further, the connector C includes obliquely wound coil springs 10, terminals 20, a connector housing 30 and a retainer 50. In the following description, upper and lower sides shown in FIG. 3 are defined as upper and lower sides concerning a vertical direction. Further, in the connector C and the mating connector 70, connecting directions (directions to bring the both connectors toward each other) are referred to as forward directions and separating directions are referred to as rearward directions.

Figure 1:
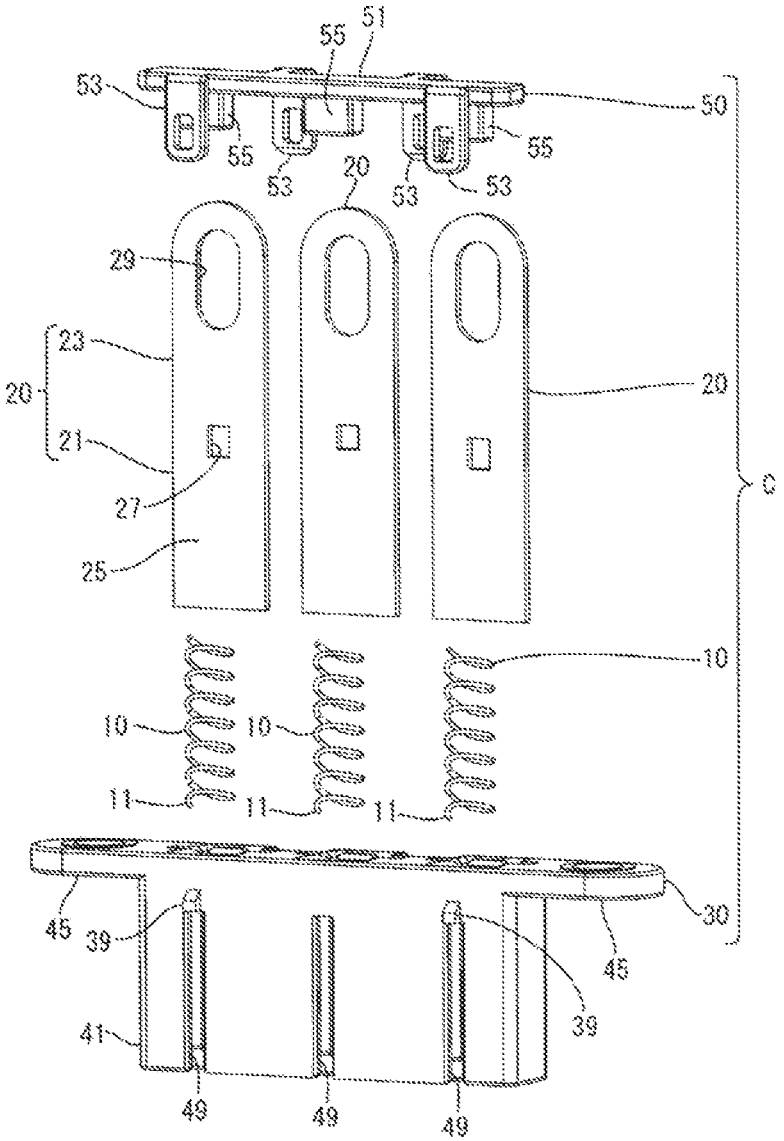
FIG. 1 is an exploded perspective view of a connector according to an embodiment.
Figure 8:
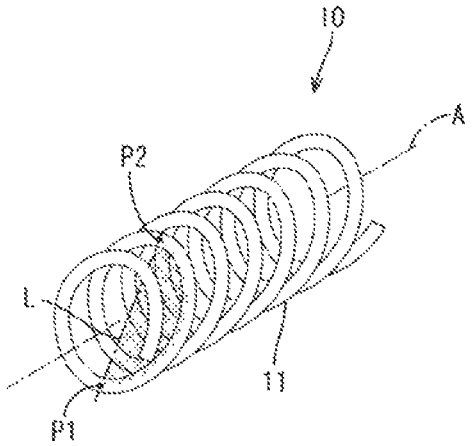
FIG. 8 is a perspective view of an obliquely wound coil spring.
Figure 9:
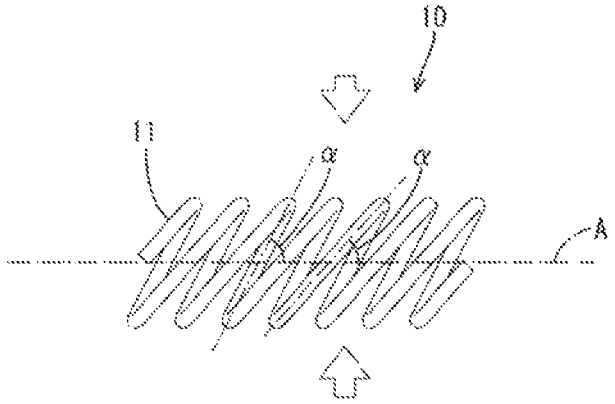
FIG. 9 is a side view of the obliquely wound coil spring.
Figure 10:
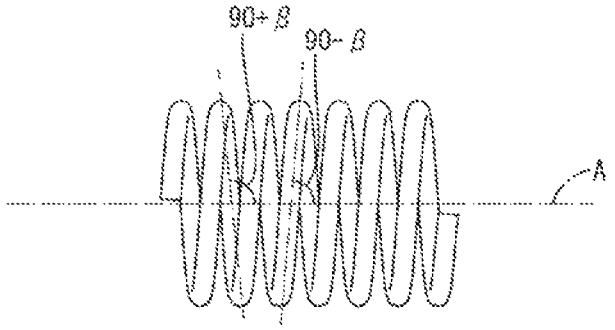
FIG. 10 is a side view of a general compression coil spring.

As shown in FIGS. 1, 8 and 9, the obliquely wound coil spring 10 is formed by spirally winding a conductive wire 11 with respect to a winding axis A, and straight along the winding axis A as a whole. As described above, if a straight line L connecting an arbitrary start point P1 of the wire 11 and an end point P2 reached by winding half turn and a virtual plane defined by the wire 11 between the points P1 and P2 (hereinafter, this is called a "half-turn winding plane") are seen, an angle of inclination of any half-turn winding plane with respect to the winding axis A differs every half turn, but within 90 degrees (tilts in the same direction) in the obliquely wound coil spring 10.

Figure 2:
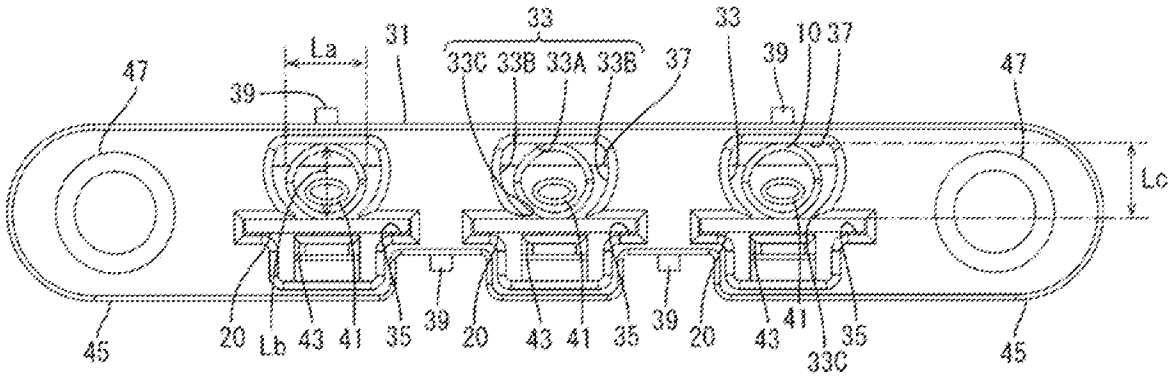
FIG. 2 is a back view of the connector before a retainer is mounted.

As shown in FIG. 2, an end surface (surface viewed from front or behind) of the obliquely wound coil spring 10 has an elliptical shape and has a dimension La in a major axis direction and a dimension Lb in a minor axis direction. Note that the dimension La in the major axis direction is larger than the dimension Lb in the minor axis direction. If loads are applied to sandwich the obliquely wound coil spring 10 from both sides in the minor axis direction, each half-turn winding plane is inclined to further tilt with respect to the winding axis A and the obliquely wound coil spring 10 is deformed to reduce a height (dimension in a direction perpendicular to the winding axis A). The obliquely wound coil spring 10 has a nonlinear region where a spring load hardly changes even if a displacement amount (displacement of the height of the spring) thereof is changed.

As shown in FIG. 1, the terminal 20 is formed by press-working a metal plate material made of copper alloy or the like and in the form of a flat plate. The terminal 20 includes a connecting portion 21 to be accommodated into the connector housing 30 and an external connecting portion 23 to be exposed behind and outside the connector housing 30. The connecting portion 21 is in the form of a flat plate having a dimension in the front-rear direction longer than a dimension of the obliquely wound coil spring 10 in an axial direction (front-rear direction) and a constant width wider than an outer diameter of the obliquely wound coil spring 10, and the upper surface thereof serves as a contact surface 25 to be brought into contact with the obliquely wound coil spring 10. Further, a locking hole 27 having a rectangular shape in a plan view and configured to lock the terminal 20 to the connector housing 30 is provided in a rear end part of the connecting portion 21. The external connecting portion 23 is provided with a long bolt hole 29 to be fixed to an external circuit by a bolt.

Figure 4:
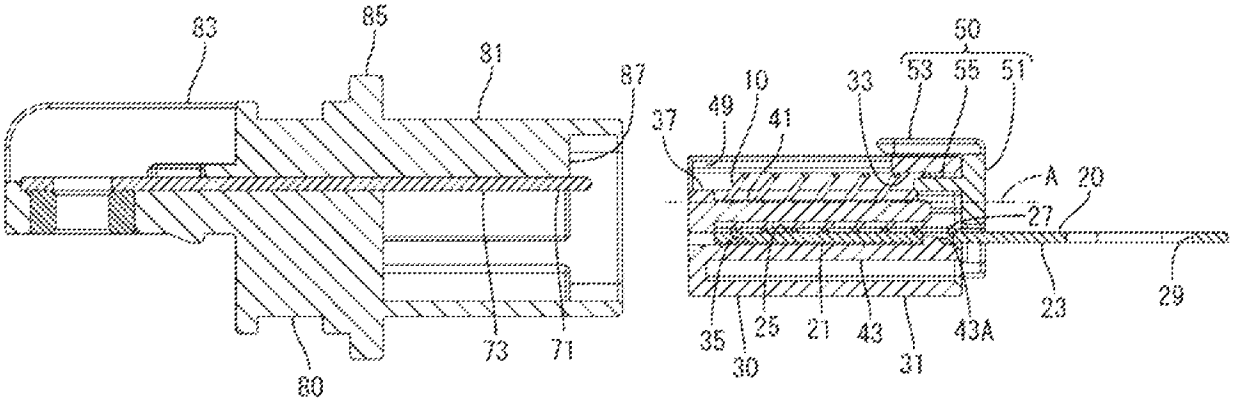
FIG. 4 is a section along IV-IV in FIG. 3.
Figure 5:
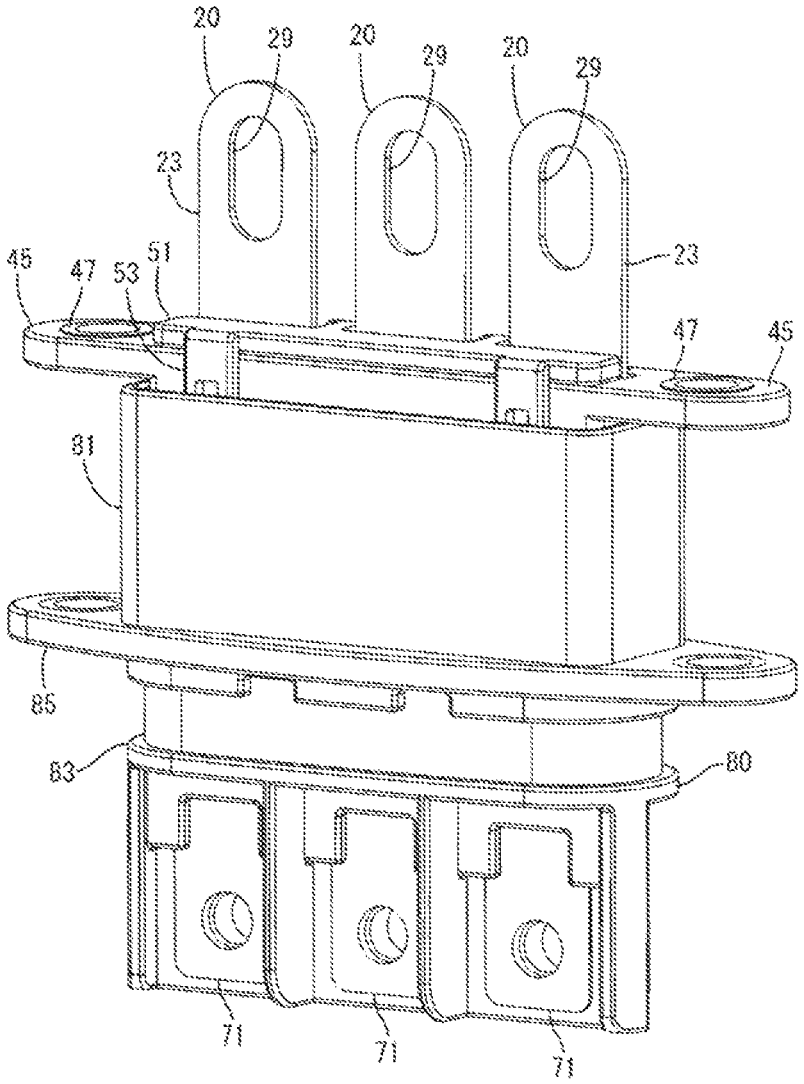
FIG. 5 is a perspective view in a state after connection to the mating connector.
Figure 6:
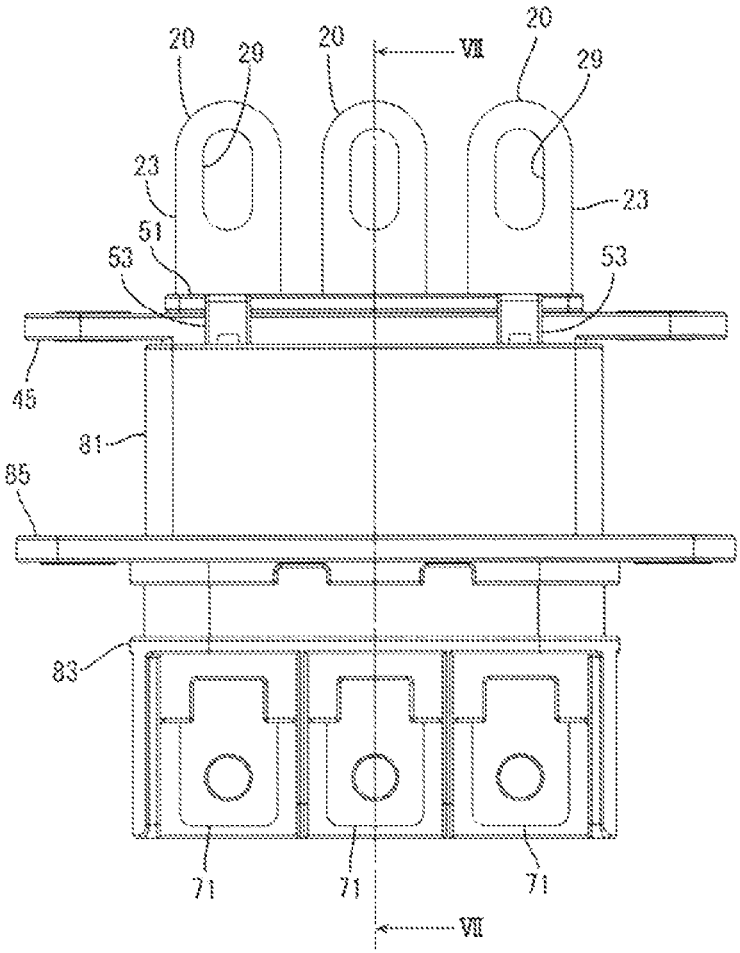
FIG. 6 is a plan view in the state after connection to the mating connector.

The connector housing 30 is made of synthetic resin and includes, as shown in FIGS. 3 and 4, a housing body 31 for accommodating the terminals 20 and the obliquely wound coil springs 10 and a flange portion 45 provided on the rear end of the housing body 31. Three spring accommodating portions 33 for accommodating the obliquely wound coil springs 10, three terminal accommodating portions 35 for accommodating the terminals 20 and insertion paths 37 provided to be open forward in upper end parts of the spring accommodating portions 33 are provided side by side in the housing body 31. Further, as shown in FIGS. 1 and 2, two retainer locking portions 39 for locking the retainer 50 are provided on each of upper and lower surfaces, out of the outer surface of the housing body 31. The retainer locking portions 39 on the upper surface side are provided above the spring accommodating portions 33 on both ends, and the retainer locking portions 39 on the lower side are provided between adjacent ones of the terminal accommodating portions 35.

As shown in FIGS. 2 and 4, the spring accommodating portion 33 extends in the front-rear direction in the housing body 31 and is open rearward. Out of the inner wall of the spring accommodating portion 33, an upper surface 33A is flat and substantially ⅓ of an upper end part serves as the insertion path 37 open forward. A mating terminal 71 to be described later is inserted into the insertion path 37 to be parallel to the terminal 20 accommodated in the terminal accommodating portion 35. Out of the inner wall of the spring accommodating portion 33, both side surfaces 33B are curved surfaces arcuate in a back view and an opening 33C is defined between lower parts of the side surfaces 33B to communicate with the terminal accommodating portion 35. The spring accommodating portion 33 has an elliptical shape as a whole in a back view. A facing dimension Lc between the terminal 20 (opening 33C) and a part (upper surface 33A) of the inner wall of the spring accommodating portion 33 facing the terminal 20 is smaller than the outer diameter (dimension La in the major axis direction) of the obliquely wound coil spring 10 in a direction perpendicular to a facing direction. Further, the facing dimension Lc is substantially equal to or slightly larger than the dimension Lb in the minor axis direction of the obliquely wound coil spring 10 in a natural state.

As shown in FIGS. 2 and 4, the spring accommodating portion 33 is provided with a shaft portion 41 extending in the front-rear direction along the winding axis A of the accommodated obliquely wound coil spring 10. The shaft portion 41 projects rearward from a center position of the front wall of the spring accommodating portion 33 and has substantially the same dimension in the front-rear direction as the obliquely wound coil spring 10 in the natural state. Further, the shaft portion 41 has an elliptical shape having a minor axis along the vertical direction when viewed from behind.

As shown in FIG. 4, the obliquely wound coil spring 10 is inserted on the shaft portion 41 and accommodated into the spring accommodating portion 33. At this time, the obliquely wound coil spring 10 are accommodated to tilt the half-turn winding planes thereof with respect to the winding axis A such that parts on the side of the insertion path 37 (side of the mating terminal 71) are on a back side in an inserting direction of the mating terminal and parts on the side of the opening 33C (side of the terminal 20) are on a front side in the inserting direction of the mating terminal. That is, the obliquely wound coil spring 10 is accommodated in the natural state into the spring accommodating portion 33 to tilt with respect to the winding axis A such that an upper side thereof is on a rear side and a lower side thereof is on a front side in a cross-section.

Further, as shown in FIGS. 1 and 4, a cutout groove 49 penetrating in the vertical direction is provided at a widthwise center position of the upper surface 33A of the spring accommodating portion 33. The cutout groove 49 is provided from the front end of the insertion path 37 to a position slightly behind a position reached by the inserted mating terminal 71. The cutout groove 49 is provided up to a front end position of the retainer locking portion 39.

As shown in FIGS. 2 and 4, the terminal accommodating portion 35 penetrates through the housing body 31 in the front-rear direction and is provided below the spring accommodating portion 33 to communicate with the spring accommodating portion 33 through the opening 33C. The terminal accommodating portion 35 holds the terminal 20 in parallel to the winding axis A of the obliquely wound coil spring 10. A vertical inner dimension of the terminal accommodating portion 35 is substantially equal to or slightly larger than a plate thickness of the terminal 20. The terminal 20 accommodated into the terminal accommodating portion 35 can obliquely contact the obliquely wound coil spring 10 through the opening 33C. Further, a locking lance 43 resiliently deformable in the vertical direction is provided on the lower surface of the terminal accommodating portion 35. The locking lance 43 is cantilevered rearward from a front end part of the housing body 31, and resiliently deformable in the vertical direction by being deflected into a deflection space provided below the locking lance 43. A projection 43A of the locking lance 43 is locked into the locking hole 27 of the terminal 20, whereby the terminal 20 is locked in the terminal accommodating portion 35.

As shown in FIGS. 1 and 2, the flange portion 45 is provided to project outward in a width direction from the rear end of the housing body 31. Collars 47 made of metal are embedded in the flange portion 45.

As shown in FIGS. 1 and 4, the retainer 50 includes a retainer body portion 51 in the form of a flat plate, locking pieces 53 to be locked to the retainer locking portions 39 of the housing body portion 31, and projecting pieces 55 configured to project into the spring accommodating portions 33. The retainer body portion 51 has a rectangular shape long in the width direction when viewed from behind to cover the three spring accommodating portions 33 from behind. The locking pieces 53 project forward from an edge part of the retainer body portion 51 in the vertical direction and are locked to the retainer locking portions 39 provided on the outer surface of the housing body portion 31. The projecting pieces 55 project forward from the front surface of the retainer body portion 51 and are to be accommodated into upper parts of the spring accommodating portions 33.

As shown in FIGS. 3 and 4, the mating connector 70 includes the mating terminals 71 and a mating housing 80. The mating terminal 71 is formed of conductive metal and in the form of a flat plate. The lower surface of one end side of the mating terminal 71 facing the terminal 20 serves as a facing surface 73.

Further, the mating terminals 71 are held in the mating housing 80 by insert molding. The mating housing 80 is made of synthetic resin and includes, as shown in FIGS. 3 and 4, a receptacle 81 to be externally fit to the housing body portion 31, a terminal block 83 to be connected to an external circuit and a mating flange 85 provided between the receptacle 81 and the terminal block 83.

The receptacle 81 is in the form of a rectangular tube so as to be externally fit to the housing body portion 31. Front end parts of the mating terminals 71 project into the receptacle 81. Terminal supporting portions 87 are provided on an upper wall in the receptacle 81 to support the mating terminals 71 in the receptacle 81. The terminal supporting portions 87 project downward from the upper wall and support the mating terminals 71. The terminal supporting portion 87 has a width narrower than an inner dimension of the cutout groove 49, and supports the mating terminal 71 through the cutout groove 49 when the connector C and the mating connector 70 are connected.

The terminal block 83 is formed such that the upper surfaces of rear end parts of the mating terminals 71 are exposed. As shown in FIG. 3, the mating flange 85 is provided to project outward in the width direction from the rear end of the receptacle 81. In the mating flange 85, collars made of metal are embedded at positions facing the collars 47 of the flange portion 45.

The connector C of this embodiment is configured as described above. Next, an assembling method and functions of the connector C are described.

As shown in FIGS. 1 and 4, the terminals 20 are accommodated into the terminal accommodating portions 35. When the terminal is pushed through a rear end opening of the terminal accommodating portion 35, the locking lance 43 is resiliently deformed downward so that the projection 43A of the locking lance 43 moves over the terminal 20. Then, the terminal 20 resiliently returns at a position where the projection 43A of the locking lance 43 is locked into the locking hole 27 of the terminal 20, and is locked at a predetermined position.

On the other hand, the obliquely wound coil springs 10 are accommodated into the spring accommodating portions 33. The obliquely wound coil spring 10 is accommodated to be inserted onto the shaft portion 41. The shaft portion 41 can fulfill a guiding function in accommodating the obliquely wound coil spring 10 into the spring accommodating portion 33 by being provided in the spring accommodating portion 33.

In accommodating the obliquely wound coil spring 10 into the spring accommodating portion 33, the obliquely wound coil spring 10 is inserted into the spring accommodating portion 33 such that a direction in which the outer diameter of the obliquely wound coil spring 10 is shorter (minor axis direction) is the vertical direction as shown in FIGS. 2 and 4. Further, the obliquely wound coil spring 10 is accommodated to tilt with respect to the winding axis A such that the upper sides of the half-turn winding planes of the obliquely wound coil spring 10 are on the rear side and the lower sides are on the front side.

As shown in FIG. 2, the obliquely wound coil spring 10 mounted in a correct orientation is restricted from rotating in the spring accommodating portion 33. Specifically, the facing dimension Lc between the terminal 20 (opening 33C) and the part (upper surface 33A) of the inner wall of the spring accommodating portion 33 facing the terminal 20 is smaller than the outer diameter (dimension La in the major axis direction) of the obliquely wound coil spring 10 in the direction perpendicular to the facing direction. Thus, if a force acts to rotate the obliquely wound coil spring 10, the half-turn winding planes of the obliquely wound coil spring 10 are tilted more with respect to the winding axis A and resistance is generated due to a resilient force. Therefore, the rotation of the obliquely wound coil spring 10 is suppressed.

Then, as shown in FIGS. 3 and 4, the retainer 50 is mounted on the housing body portion 31. The retainer body portion 51 is mounted to cover the rear end openings of the spring accommodating portions 33 from behind the housing body portion 31, and the projecting pieces 55 are inserted into the spring accommodating portions 33. Then, the locking pieces 53 are locked to the retainer locking portions 39 provided on the outer surface of the housing body portion 31, whereby the retainer 50 is mounted on the housing body portion 31.

The connector C thus assembled and the mating connector 70 are connected. When the housing body portion 31 of the connector C starts being fit into the receptacle 81 of the mating connector 70, tip parts of the mating terminals 71 are inserted through front end openings of the insertion paths 37. When the connector C and the mating connector 70 are brought even closer, the terminal supporting portions 87 for supporting the mating terminals 71 enter the cutout grooves 49 while the mating terminals 71 move rearward in the insertion paths 37.

Further, when the connector C and the mating connector 70 are brought even closer, the mating terminals 71 move rearward in the insertion paths 37 (upper end parts of the spring accommodating portions 33) while pressing the outer peripheries of the obliquely wound coil springs 10. At this time, since the obliquely wound coil springs 10 are accommodated in the spring accommodating portions 33 to tilt the half-turn winding planes thereof with respect to the winding axis A such that the parts on the side of the insertion paths 37 (side of the mating terminals 71) are on the back side in the inserting direction of the mating terminals 71 and the parts on the side of the openings 33C (side of the terminals 20) are on the front side in the inserting direction of the mating terminals, the mating terminals 71 can move without being caught by the obliquely wound coil springs 10 and insertion forces for the mating terminals 71 can be reduced.

Figure 7:
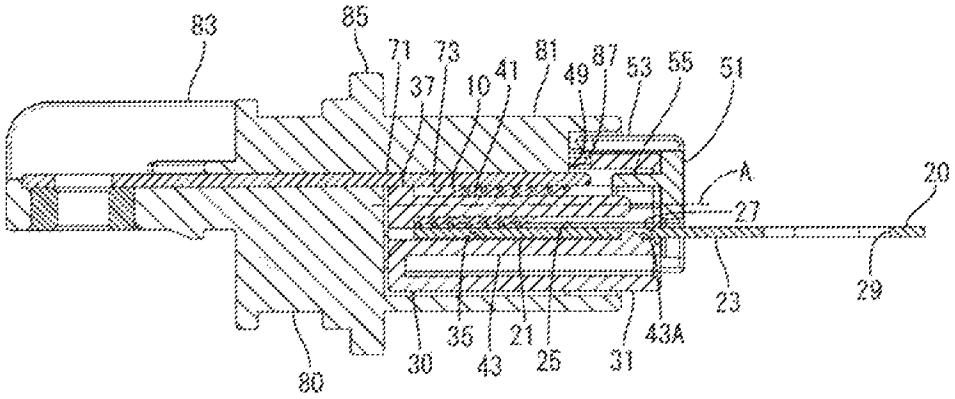
FIG. 7 is a section along VII-VII in FIG. 6.

When the connector C and the mating connector 70 are connected as shown in FIG. 7, the contact surfaces 25 of the terminals 20 and the facing surfaces 73 of the mating terminals 71 face parallel to each other and the obliquely wound coil springs 10 are sandwiched between the contact surfaces 25 of the terminals 20 and the facing surfaces 73 of the mating terminals 71. Then, the terminals 20 and the mating terminals 71 are electrically connected via the obliquely wound coil springs 10. At this time, since the terminals 20 are supported on the inner walls of the terminal accommodating portions 35 and the mating terminals 71 are supported on the terminal supporting portions 87, a sufficient load can be applied to the obliquely wound coil springs 10 to ensure a contact pressure. Further, since the shaft portions 41 are inserted in the obliquely wound coil springs 10, it can be suppressed that end parts of the obliquely wound coil springs 10 are settled even if a load is applied more than expected.

As described above, in the connector C of this embodiment, when the mating terminal 71 is disposed parallel to the terminal 20 by being inserted into the insertion path 37, the obliquely wound coil spring 10 is sandwiched between the mating terminal 71 and the terminal 20 and the terminal 20 and the mating terminal 71 are electrically connected. Since the half-turn winding planes of the obliquely wound coil spring 10 are restricted in such a rotation posture as to tilt with respect to the winding axis A of the obliquely wound coil spring 10 by the spring accommodating portion 33 such that the parts on the side of the mating terminal 71 are on the back side in the inserting direction of the mating terminal 71 and the parts on the side of the terminal 20 are on the front side in the inserting direction of the mating terminal 71, it can be suppressed that the mating terminal 71 is caught by the obliquely wound coil spring 10 and an insertion force for the mating terminal 71 can be reduced. Further, since the terminal 20 is in the form of a flat plate and formed by simple press-working, cost can be reduced.

The invention is not limited to the above described and illustrated embodiment. For example, the following various modes are also included.

Although the shaft portion 41 is provided in the spring accommodating portion 33 in the above embodiment, the shaft portion 41 may be omitted.

Although the rotation of the obliquely wound coil spring 10 is restricted by the inner dimension of the spring accommodating portion 33 in the above embodiment, the rotation may be restricted by another structure such as a structure for suppressing rotation by the contact of the shaft portion with an inner side of the obliquely wound coil spring 10 when the obliquely wound coil spring 10 is going to rotate by adjusting an outer diameter of the shaft portion.

LIST OF REFERENCE SINGS

10 . . . obliquely wound coil spring
20 . . . terminal
30 . . . connector housing
31 . . . housing body
33 . . . spring accommodating portion
33A . . . upper surface
33B . . . side surface
33C . . . opening
35 . . . terminal accommodating portion
37 . . . insertion path
41 . . . shaft portion
50 . . . retainer
70 . . . mating connector
71 . . . mating terminal
80 . . . mating housing
C . . . connector
P1 . . . start point
P2 . . . end point
A . . . winding axis

The invention claimed is:

1. A connector, comprising:

a connector housing made of synthetic resin and having a spring accommodating portion and a terminal accommodating portion adjacent the spring accommodating portion, a part of the spring accommodating portion opposite the terminal accommodating portion defining an insertion path for receiving a mating terminal along an inserting direction;

a terminal in the form of a flat plate inserted in the terminal accommodating portion;

an obliquely wound coil spring formed by spirally winding a conductive wire with respect to a winding axis, disposed in the spring accommodating portion such that the winding axis thereof and the terminal are parallel, and the obliquely wound coil spring being dimensioned and configured to be sandwiched between the terminal and the mating terminal in the form of a flat plate that is inserted into the insertion path; and the obliquely wound coil spring and the spring accommodating portion having cross-sectional shapes configured to restrict the obliquely wound coil spring in such a rotation posture as to tilt with respect to the winding axis such that a mating terminal side of a half-turn winding plane defined by a half turn of the wire and a straight line connecting a start point and an end point of the half turn is on a back side in an inserting direction of the mating terminal and a terminal side thereof is on a front side in the inserting direction.

2. The connector of claim 1, wherein:

the rotation restriction is defined by making a facing dimension between the terminal and a part of an inner wall of the spring accommodating portion facing the terminal smaller than an outer diameter of the obliquely wound coil spring in a direction perpendicular to a facing direction.

3. The connector of claim 2, wherein the spring accommodating portion includes a shaft portion provided along the winding axis of the obliquely wound coil spring and inserted in the obliquely wound coil spring.

4. The connector of claim 2, wherein the obliquely wound coil spring has an elliptical shape transverse to the winding axis to define a major axis dimension and a minor axis dimension that is smaller than the major axis dimension, the obliquely wound coil spring being disposed in the spring accommodating portion such that the minor axis dimension is perpendicular to the flat plate of the terminal and is sufficiently large for the obliquely wound coil spring to project into the insertion path.

5. The connector of claim 4, wherein the major axis dimension of the obliquely wound coil spring is greater than a dimension measured perpendicular to the flat plate of the terminal and extending from the terminal to a side of the insertion path opposite the terminal, thereby restricting rotation of the obliquely wound coil spring away from the rotation posture where the minor axis dimension is perpendicular to the flat plate of the terminal.

6. The connector of claim 1, wherein the connector housing has opposite front and rear ends, the spring accommodating portion and the terminal accommodating portion extending from the rear end of the connector housing toward the front end of the connector housing, the insertion path extending into the front end of the connector housing toward the rear end of the connector housing.

7. The connector of claim 6, wherein the spring accommodating portion has an elliptical cross-sectional shape transverse to a direction extending from the front end of the connector housing to the rear end of the connector housing, the obliquely wound coil spring having an elliptical cross-sectional shape substantially conforming to the elliptical cross-sectional shape of the spring accommodating portion, thereby restricting rotation.

8. The connector of claim 6, further comprising a retainer mounted on the rear end of the connector housing and configured for retaining the obliquely wound coil spring in the spring accommodating portion.

9. A connector, comprising:

a connector housing having opposite front and rear ends spaced apart along a front-rear direction, a terminal accommodating portion and a spring accommodating portion extending in the front-rear direction and being adjacent to one another, a part of the spring accommodating portion opposite the terminal accommodating portion defining an insertion path for receiving a mating terminal;

a terminal having a flat plate inserted in the terminal accommodating portion; and an obliquely wound coil spring formed by spirally winding a conductive wire with respect to a winding axis and disposed in the spring accommodating portion such that the winding axis and the terminal are parallel, wherein the obliquely wound coil spring and the spring accommodating portion have elliptical cross-sectional shapes transverse to the front-rear direction, the elliptical cross-sectional shapes defining minor axes aligned perpendicular to the flat plate of the terminal and restricting rotation of the obliquely wound coil spring in the spring accommodating portion about the winding axis, a minor axis dimension of the obliquely wound coil spring is sufficiently large for the obliquely wound coil spring to project into the insertion path and to be sandwiched between the terminal and the mating terminal in the form of a flat plate that is inserted into the insertion path, the obliquely wound coil spring having a rotation posture to tilt with respect to the winding axis such that a mating terminal side of a half-turn winding plane defined by a half turn of the wire and a straight line connecting a start point and an end point of the half turn is on a back side in an inserting direction of the mating terminal and a terminal side thereof is on a front side in the inserting direction.

10. The connector of claim 9, wherein the connector housing has opposite front and rear ends, the spring accommodating portion and the terminal accommodating portion extending from the rear end of the connector housing toward the front end of the connector housing, the insertion path extending into the front end of the connector housing toward the rear end of the connector housing.

11. The connector of claim 10, further comprising a retainer mounted on the rear end of the connector housing and configured for retaining the obliquely wound coil spring in the spring accommodating portion.

12. The connector of claim 9, wherein the spring accommodating portion includes a shaft portion provided along the winding axis of the obliquely wound coil spring and inserted in the obliquely wound coil spring.

* * * * *